US009514720B1

(12) United States Patent
Acocella

(10) Patent No.: US 9,514,720 B1
(45) Date of Patent: Dec. 6, 2016

(54) HI-HAT MUSICAL DEVICE

(71) Applicant: Nicholas Acocella, Woodland Park, NJ (US)

(72) Inventor: Nicholas Acocella, Woodland Park, NJ (US)

( * ) Notice: Subject to any disclaimer, the term of this patent is extended or adjusted under 35 U.S.C. 154(b) by 0 days.

(21) Appl. No.: 14/843,093

(22) Filed: Sep. 2, 2015

(51) Int. Cl.
*G10D 13/02* (2006.01)
*G10D 13/06* (2006.01)

(52) U.S. Cl.
CPC ..... *G10D 13/065* (2013.01); *G10D 13/026* (2013.01)

(58) Field of Classification Search
CPC ..... G10D 13/065; G10D 13/026
See application file for complete search history.

(56) References Cited

U.S. PATENT DOCUMENTS 1,613,978 A * 1/1927 Berton ..... G10D 13/065 84/402
3,167,995 A * 2/1965 La Londe ..... G10D 13/065 84/421
3,742,810 A * 7/1973 Crigger ..... G10D 13/065 84/422.3
4,177,709 A * 12/1979 Adams ..... G10D 13/065 84/402
4,274,322 A * 6/1981 Cordes ..... G10D 13/065 84/422.3
5,018,426 A 5/1991 Suzuki
5,367,939 A * 11/1994 Barker ..... G10D 13/06 446/421
6,878,868 B2 4/2005 McMillan
7,329,810 B2 * 2/2008 Spivack ..... G10D 13/065 84/422.1
8,198,522 B2 6/2012 Michael
2012/0210843 A1 8/2012 Sato
2014/0096664 A1 4/2014 Nakata et al.

OTHER PUBLICATIONS

Moraux et al.; "Ankle dorsi—and plantar-flexion torques measured by dynamometry in healthy subjects from 5 to 80 years"; BMC Musculoskeletal Disorders, Biomed Central; 2013; 11 pages.

* cited by examiner

*Primary Examiner* — Robert W Horn
(74) *Attorney, Agent, or Firm* — Ohlandt, Greeley, Ruggiero & Perle, L.L.P.

(57) ABSTRACT

A leg-mountable hi-hat musical device.

20 Claims, 7 Drawing Sheets

HI-HAT MUSICAL DEVICE

DESCRIPTION OF RELATED ART

A traditional hi-hat percussion instrument, or hi-hat, is a standard element of a percussionist's drum kit. A conventional hi-hat has two convex cymbals that are mounted on a stand, one on top of the other, and a pedal that can be used to clash and hold the cymbals together. The hi-hat generates sound by causing cymbals to come together, with one cymbal being attached to a fixed tube and the other cymbal being mounted on a bar that moves up and down and is caused to move by means of an operating device. An upper cymbal is movable, and the lower cymbal is fixed. When the pedal is moved, the bar, which is mounted at the lower end of the pedal by means of a spring and has its upper end attached to the upper cymbal, moves down inside a tube. The upper cymbal strikes the oppositely mounted cymbal that is attached to the tube. This results in generation of a typically metallic long-sustained sound.

The pedal of a traditional hi-hat stand is almost directly below the cymbals, which are supported by a hollow vertical tube. The top cymbal is mounted horizontal and bell up, while an adjustment screw allows the bottom cymbal to be either horizontal or slightly tilted. A narrow metal shaft or rod runs through both cymbals and the tube and connects to the pedal. The top cymbal is connected to the rod with a clutch, and can be lowered by operating the pedal against a spring between the cymbals, which holds it up in the "open" position, while the bottom cymbal remains stationary. The height of the top cymbal with the pedal released is adjustable by varying the position of the clutch on the center shaft. When the hats are closed, the pressure holding them together can be varied by varying the foot pressure.

In a traditional hi-hat when a foot plate of the pedal is pressed, the top cymbal crashes onto the bottom cymbal (closed hi-hat). When released, the top cymbal returns to its original position above the bottom cymbal (open hi-hat). The spring tension controls the amount of pressure required to lower the top cymbal, and how fast it returns to its open position, and can also be varied.

In operation, hi-hats are used as rhythmic instruments, which are generally operated in a timely fashion the percussion instruments with the foot control. The other foot is likewise used for a bass drum.

Currently and historically standard hi-hat cymbals are of different sizes. Until the late 1960s, standard hi-hats were 14 inches (36 cm), with 13 inches (33 cm) available as a less-common alternative in professional cymbal ranges. In the early 1970s, hard rock drummers employed 15-inch hi-hats, and in the 1980s, 10 inch and 12 inch mini hats were used professionally. By the 1990s there were hi-hats as small as 8 inches (20 cm), but by the end of the 1990s, the standard cymbal size returned to 14 inches, with 13 inches as a less-common alternative, although smaller cymbals can be used. Some drummers even use mismatched hi-hats from different cymbal ranges.

SUMMARY

A hi-hat musical device comprising: a spring mechanism a pair of arms connected to the spring mechanism comprising an upper arm including a mount for an upper cymbal; and a lower arm including a mount for a lower cymbal; a foot pedal; a hi-hat cabling mechanism including a cable configured to operatively connect the foot pedal to the hi-hat device, wherein the cable passes through a channel formed through the lower arm, a pair of hi-hat cymbals when mounted and fastened, and the upper arm; and a leg engagement mechanism for mounting the hi-hat musical device on a user's leg.

In an embodiment, the spring mechanism can comprise a coil compression spring. In an embodiment, hi hat musical device can comprise a cymbal adjustment mechanism for adjusting and setting the open distance between an upper hi-hat cymbal and a lower hi-hat cymbal mounted on the hi-hat musical device. In an embodiment, the cymbal adjustment mechanism can comprise a tension adjustment mechanism configured to adjust the tension of the spring mechanism. In an embodiment, the tension adjustment mechanism can be positioned to adjust the tension of the coil compression mechanism.

In an embodiment, the spring mechanism can comprise a flat spring. In an embodiment, the flat spring can comprise a C-Spring. In an embodiment, a lower end of the C-Spring is positioned on and fastened to the lower arm, curves upward to form a semi-ellipse such that at the apex of the C-shape the C-spring curves under and then bends normal to vertical such that the upper end of the flat spring extends horizontally along the hi-hat musical device. In an embodiment, the C-Spring comprises a monotonic spiral. In an embodiment, the monotonic spiral comprises a $\phi$ curve or Fibonacci spiral.

In an embodiment, a coil compression spring can be positioned vertically between a lower end and an upper end of the flat spring. In an embodiment, an upper end of the C-spring can be attached to the lower surface of an upper arm, and a lower end of the C-spring is attached to a top surface of a lower arm. In an embodiment, the spring mechanism comprises a torsion spring. In an embodiment, the pair of arms are adjustable to accommodate different sized hi-hat cymbals. In an embodiment, the pair of arms each include a telescoping portion adjustably fastened to each arm. In an embodiment, the leg engagement mechanism in comprises a lower leg engagement mechanism attached to the telescoping portion.

In an embodiment, the musical device comprises an upper cymbal and a lower cymbal positioned horizontally along the cabling mechanism. In an embodiment, the cabling mechanism operably attaches to the foot pedal to the hi-hat device. In an embodiment, a clutch attaches an upper portion of the cabling mechanism to an upper arm of the hi-hat device. In an embodiment, the leg engagement mechanism comprises an upper leg brace configured to rest on a user's thigh attached to an upper portion of the lower arm and a lower leg brace attached to a lower portion of the lower arm.

DETAILED DESCRIPTION OF EMBODIMENTS

Figure 1A:
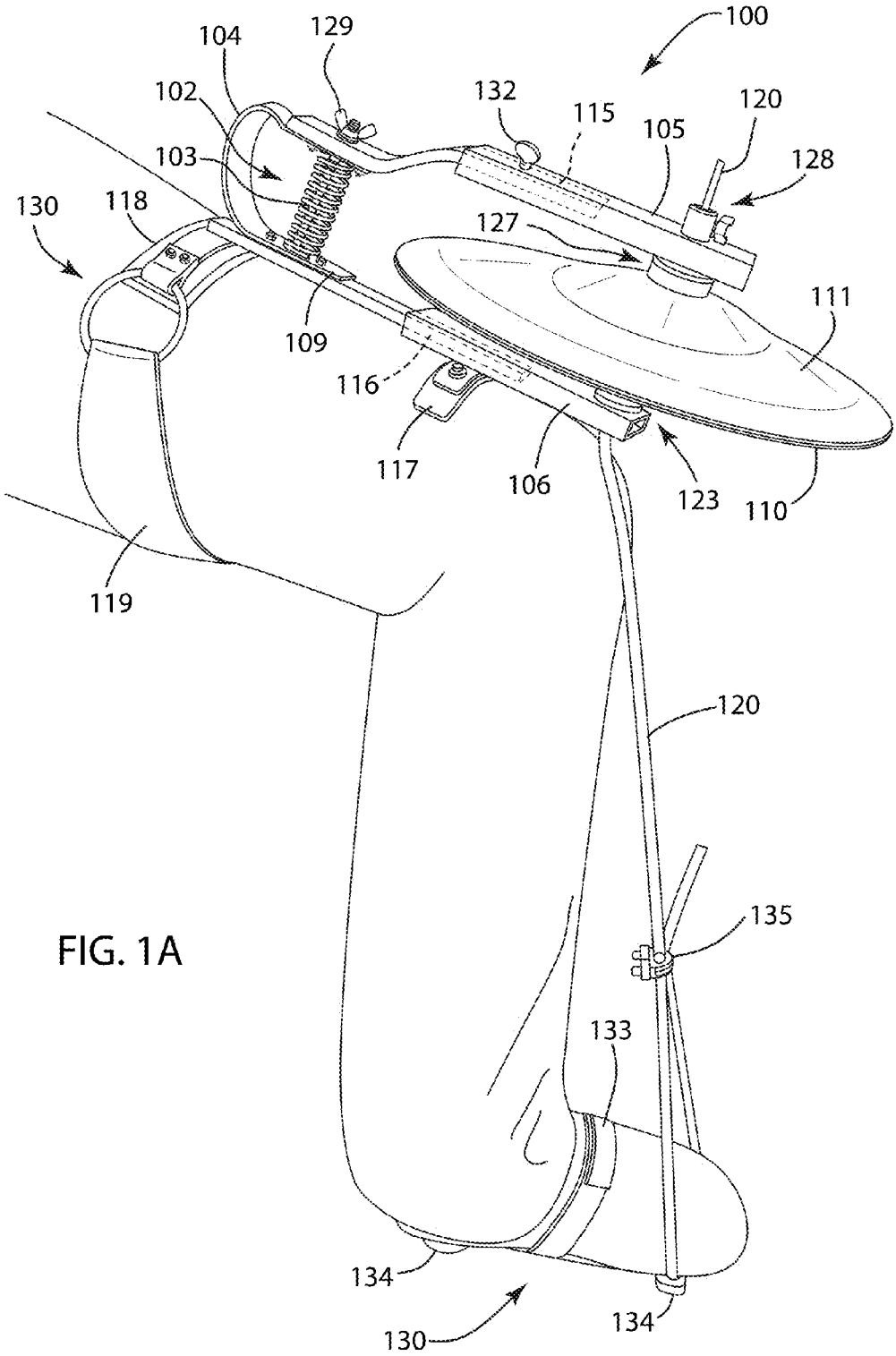
FIG. 1A shows a profile view of an embodiment of the hi-hat musical device.

Various embodiments now will be described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention. In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The present invention will now be described in detail on the basis of exemplary embodiments.

FIGS. 1A-1F shows an embodiment of a hi-hat musical device. The hi-hat musical device 100 comprises a spring mechanism 102 including a spring, a pair of arms 105, 106 operatively connected to the spring mechanism 102 comprising an upper arm 105 including an upper cymbal mount 127 for an upper cymbal 110 and a lower arm 106 including a lower mount 123 for a lower cymbal 111. The hi-hat device comprises a foot pedal and a hi-hat cabling mechanism 101 including a cable 120 configured to operatively connect a foot pedal 130 to the hi-hat device. The cable 120 can approximate the diameter of conventional hi-hat stand rods (e.g.: ¼") and be made from steel or rope or any material capable of bearing repeated pulling and releasing to close and open the cymbals 110,111 in play. For example, in embodiments, the cable 120 may be a single cable, e.g., a single strand metal wire or multiple braided or wound wires. The cable 120 passes through a channel 122 formed by openings through the lower arm 106, a pair of hi-hat cymbals when mounted, and the upper arm 105; and is secured by a clutch positioned through and above the upper arm 105. The clutch 128 can also form the channel 122, for example via a threaded sleeve 126. The high hat device 100 also includes a leg engagement mechanism 117. The hi-hat musical device 100 is adapted to be mounted and playable on a user's leg.

In an embodiment the spring mechanism 102 comprises a flat spring 104. Examples of flat springs that can be employed include a C-Spring. Other flat springs 102 can be employed, for example a beam with cantilevered upper and lower arms, a V spring, or other spring configurations known to ordinarily skilled artisans as informed by the disclosure of the present specification. The spring mechanism 102 can also comprise a tension spring, leaf spring, compression spring, or other spring components.

Hi-hat cymbals vary in weight. Accordingly in setting spring tension, the upward spring force holding them apart is neither too weak, so that they will not rest too close together, nor too strong, so that it does not take uncomfortable effort to press the foot pedal down. The spring force required to comfortably and responsively handle the range of cymbals that can be used is greater than gravity's downward pull upon the heaviest top high-hat cymbals, while at the same time low enough to compress down by foot with ease. The further the top cymbal is pressed down, the greater the counterforce of the spring is to open the cymbals apart, as expressed in Hooke's Law—the strength of the force a spring exerts against compression is proportional to the distance it is compressed ($F=-kx$, where k is the constant force the spring exerts, x the distance the spring is compressed, and F the force necessary to close the cymbals x distance against k).

A restoring spring force of about 5 lbs is sufficient as hi-hat cymbals are generally between 1-4 lbs, and the restoring force increases with compression. A stronger restoring force can be employed for more responsive kick-back for opening cymbals, enabling quicker playing action; a desirable feature for percussionists who rely on their hi-hat work for fills or fast-paced music. Mean plantar flexion (the downward press movement of the front of the foot, as in foot-tapping) load for 5-9 year olds is already over 8 lbs, and for 20-29 year olds it averages at 117 lbs; in an embodiment, a restoring force at the low end of this range can be employed where the load exceeds the weight of the top hi-hat.

In embodiments the C-Spring flat spring 104 can include any of the varieties and modifications of the C-Shape. For example in an embodiment the flat spring 104 of the spring mechanism 102 includes a C-Spring, which is formed to include a curve resembling the letter C between the ends of the spring. In an embodiment the C-shape can be substantially uncurved, where the upper end and lower end of the spring mechanism may extend at right angles from the middle portion of the C-spring of the hi-hat musical device in a cantilevered fashion, as shown in the exemplary embodiment of FIG. 2A. In embodiments, the upper arm 105 and lower arm can be attached to the ends of the C-spring, or in other embodiments the ends can extend laterally to form the upper arm 105 and lower arm 106 respectively.

In an embodiment, an upper end 108 of the C-shaped flat spring 104 is attached to the lower surface of an upper arm 105, and the lower end 109 of the C-Shaped flat spring 106 is attached to a top surface of a lower arm 106.

In embodiments, the C-shaped flat spring 104 can be formed along any desired curvature. Sharper curvature will snap back hard and quickly into resting position, while taking more force to compress. Gentler curvature is easier to compress, and in turn responds lighter and with softer backlash. Whether the flat bar of the flat spring 104 is bent into a sharper or gentler curve, an equiangular curve can distribute wear at the same focal points over time as the cymbals are compressed over and over, as the midpoint of the curve on any strictly circular section will take the most strain with every compression and deformation will eventually occur.

As shown in FIGS. 1A-1F, in an embodiment the flat spring 104 comprises a C-shaped flat spring 104 with modification. In the embodiment the lower end 109 of the flat spring 104 is positioned on and fastened to the lower arm 106, which runs horizontally along the hi-hat musical device 100. The flat spring then curves upward to form a semi-ellipse such that at the apex 107 of the C-shape the C-spring 104 curves under and then bends normal to vertical such that the upper end 108 of the flat spring 104 extends horizontally along the hi-hat musical device 100, for example as a cantilever.

In an embodiment, the flat spring 104 comprises an inward spiral, one advantage being the sharpening spiral spreads the focal points of bending strain down the axis of the curve as it is compressed. In an embodiment, the spiral of the flat spring 104 comprises a monotonic spiral, for example a spiral of the function $\phi$, or "Fibonacci spiral," which logarithmically increases the degrees of sharpness in the curvature as it is compressed, thus increasing the power and speed the cymbals will snap back open with for greater and more acute responsiveness in play. The compression coil 103 spring between the arms 105, 106 and in front of the curve of the flat spring 104 is configured to provide restoring force between the arms 105, 106. It is situated outside the perimeter of the cymbals between the upper arm 105 and lower arm 106.

In embodiments, the spring mechanism 102 includes a coil compression spring 103. For example, in an embodiment, the coil compression 103 spring can be positioned vertically between the ends 108,109 of the flat spring 104, for example between the lower end 109 and upper end 108 of the flat spring 104. Splitting the restoring force between a coil compression spring 103 and a curved metal bar of the flat spring 104 with elasticity lessens the wear on either spring 103, 104 singly. As will be appreciated, the C-shaped flat spring 104 also serves to keep the arms of the leg-mounted hi-hat system continuous with each other).

Figure 1B:
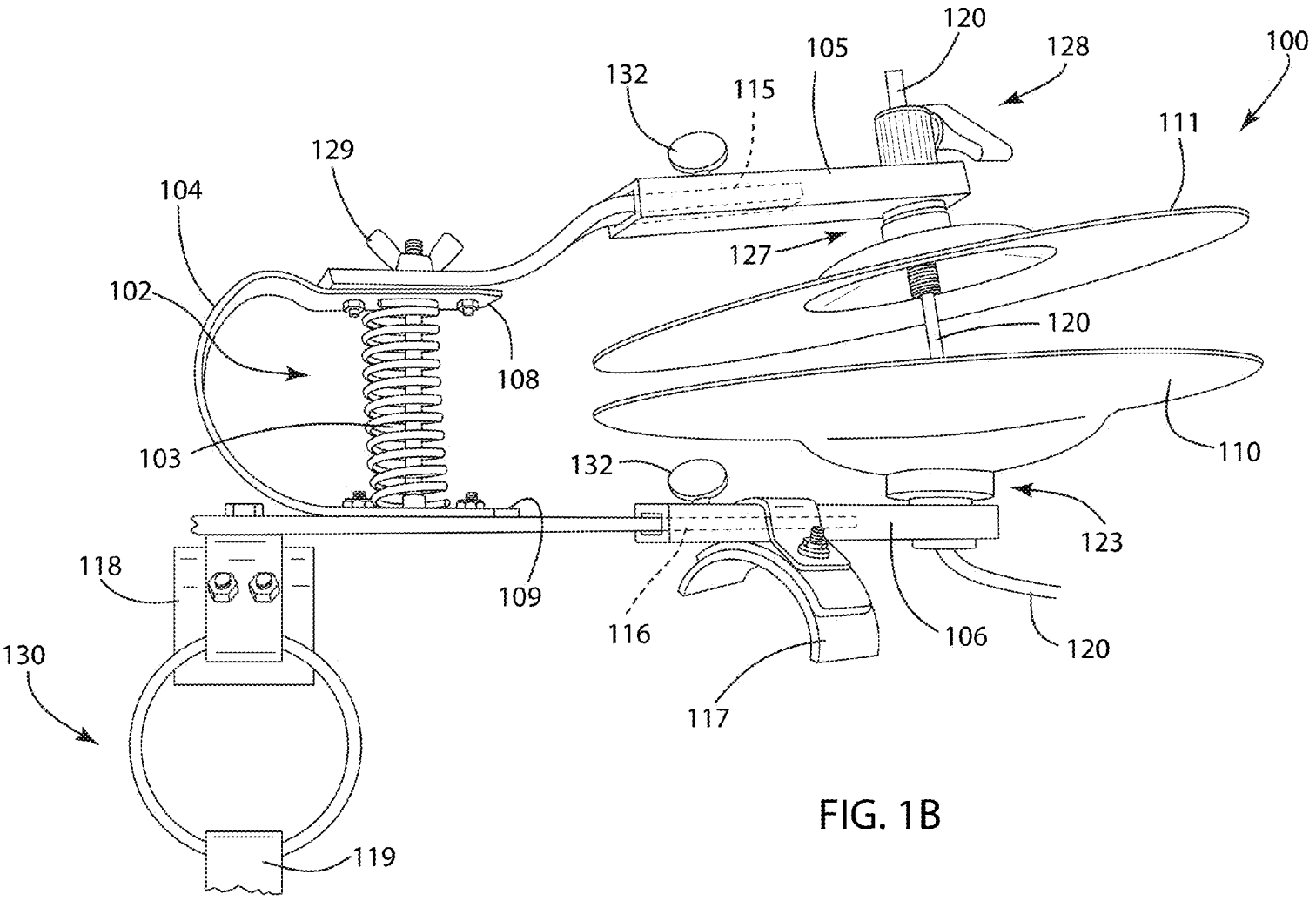
FIG. 1B shows a profile view of an embodiment of the hi-hat musical device.
Figure 1C:
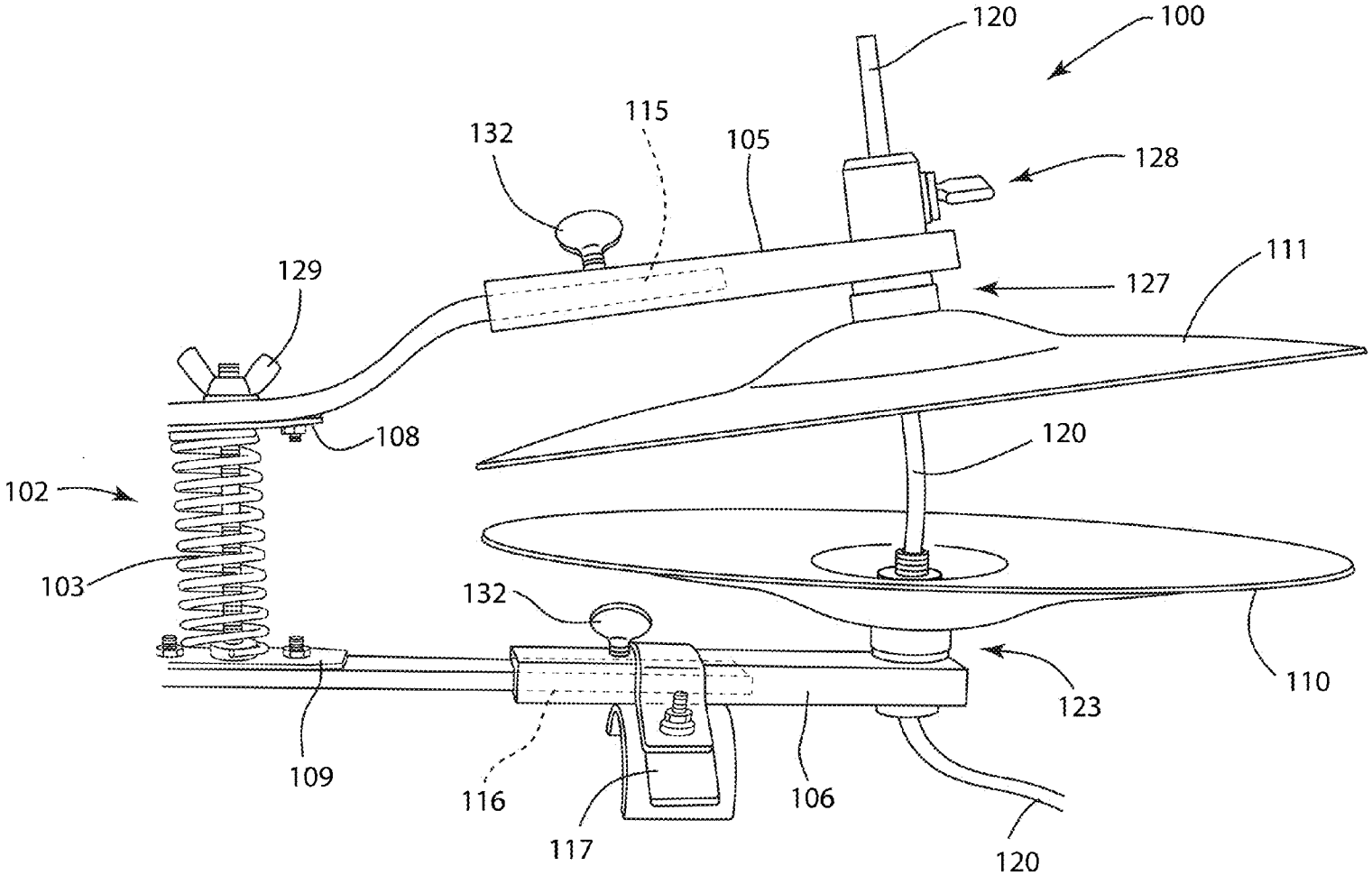
FIG. 1C shows a profile view of an embodiment of the hi-hat musical device.
Figure 1D:
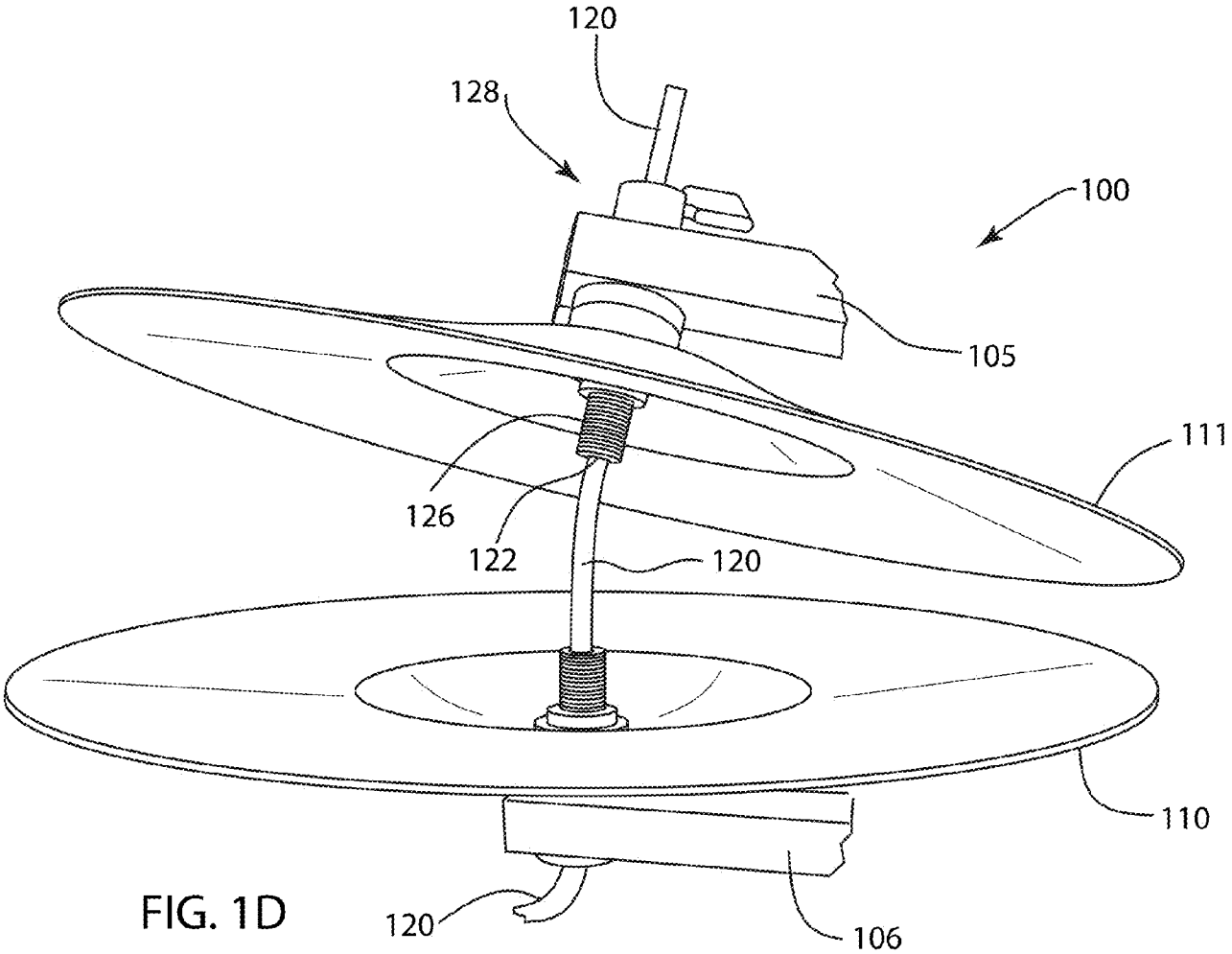
FIG. 1D shows a view of an internal view of the hi-hat cymbals as mounted in embodiment of the hi-hat musical device.
Figure 1E:
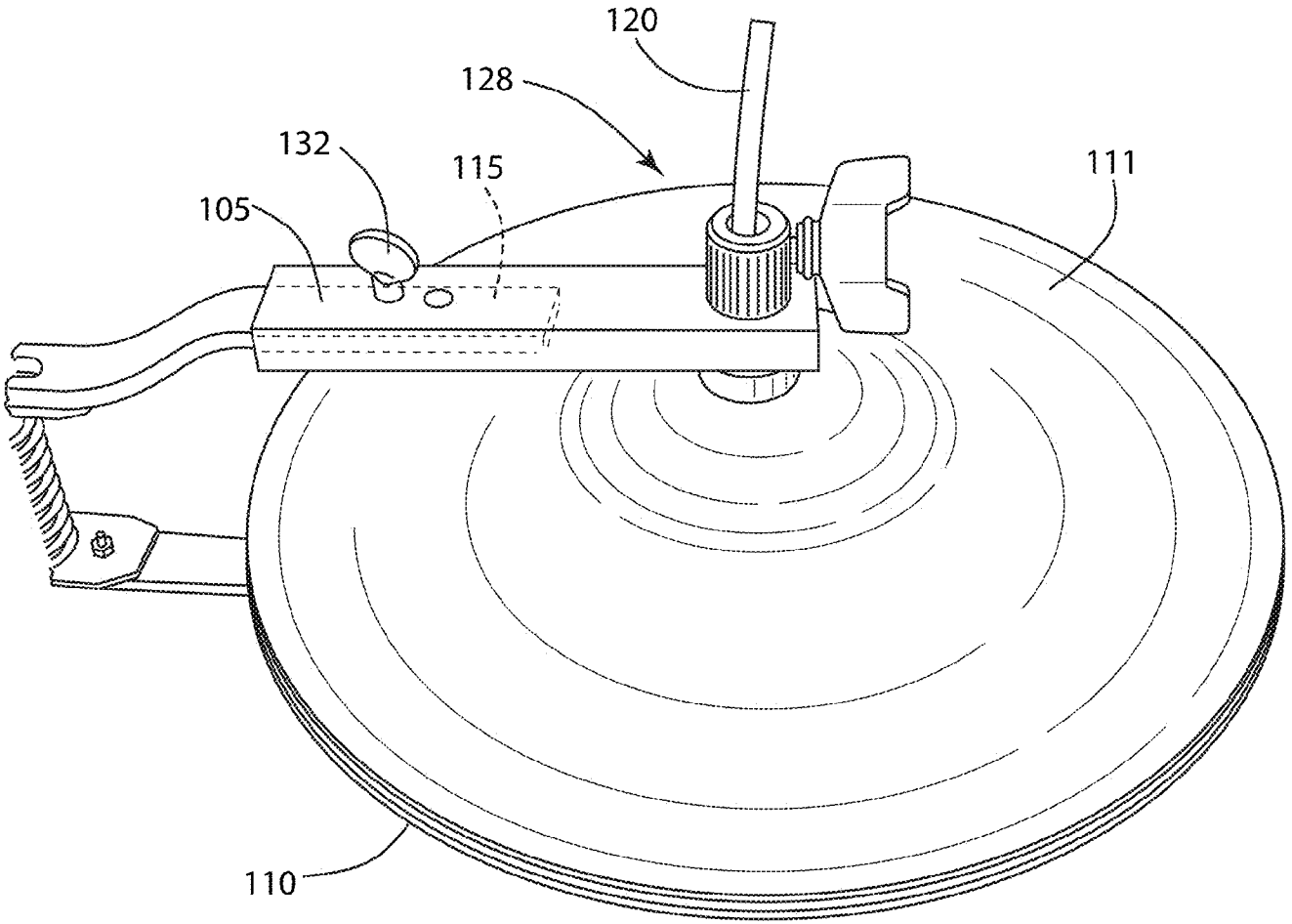
FIG. 1E shows a plan view of the hi-hat musical device including a mounted upper hi-hat cymbal.

In an embodiment, the hi-hat musical device 100 can be configured such that the hi-hat cymbals 110, 111 can be further apart or closer together in the neutral, open position. A tension adjustment mechanism 129 for the coil compression spring 103 allows the user to increase or reduce the tension of the coil, thereby respectively reducing or increasing the distance of the upper hi-hat cymbal from the lower hi-hat cymbal 111. For example, as shown in FIGS. 1B and 1C the tension adjustment mechanism can be a wing nut or tightener with a screw or threaded rod which extends through an opening in the upper arm 105, for example at the upper end of the modified C-Spring flat spring 104, through the center of the compression coil 103, and through the lower end 109 of the lower arm 106 at the end of the modified C-Spring flat spring 104 and then fastened to the lower arm 106 of the hi-hat device 100. Tightening the wing nut compresses the compression spring 103 to bring the arms 105, 106 closer together, whereas loosening the wing nut allows the compression spring 103 to expand, thereby increasing the distance between the arms 105, 106 in the rest position. Accordingly, when the hi-hat cymbals 110, 111 are installed on the hi-hat musical device 101, the user can adjust the open position between the cymbals 110, 111 to the user's preference as well as set a maximum limit for such distance. Of course as will be appreciated other structures and mechanisms can be employed to adjust the space between the upper and lower arms 105, 106.

In an embodiment the hi-hat musical instrument can be configured to be adjustable to fit different sized cymbals. For example an embodiment can include adjustable arms 105, 106 that extend and retract to accommodate larger and smaller hi-hat cymbals respectively. As shown in FIGS. 1A-1C, the upper arm 105 includes an upper telescoping slider 115 and the lower arm 106 includes a lower telescoping slider 116, each of which are adjustable laterally to accommodate a larger upper cymbal 110 and lower cymbal 111. The upper and lower telescoping sliders 115, 116 are shown as fastened to the upper arm 105 and lower arm 106 respectively via a fastener, for example a nut and screw. The upper and lower telescoping sliders 115, 116 each include a channel through the center of the sliders that are configured to form a sleeve around the respective upper and lower arms 105, 106. For each telescoping slider 115,116 the channel allows the telescoping slider 115, 116 to slide laterally along the arm, which can be fixed into position with the fastener. In another embodiment the telescoping sliders 115,116 can include other fasteners or fixing structures as known in the art as informed by the present specification, for example, a tongue in the telescoping slider 115,116 configured to fix into preset grooves or openings in the arm 105,106.

Thus the arms 105, 106 of this leg-mounted hi-hat instrument can be telescoping, for example employing telescopic sliders 115,116 configured to extend out or retract in, so that different diameter cymbals 110, 111 can be used without infringing on the coil spring 103 fixed between the arms. The length of each arm 105, 106 can be adjusted with the telescoping sliders 115, 116, using for example tighteners 132 such as a hand tightening set screw—a thumb screw or knob screw for example—that screws through a screw hole for it in the hollow arm 105,106 and onto the arm 105, 106 inside it for as full extension as possible. In an embodiment, the outer telescoping slider 115, 116 arm the cymbal 110, 111 fastens to can be hollow with the inner arm 105, 106 it telescopes over being solid. In another embodiment, the inner arm 105, 106 can be hollow with the outer telescoping slider 115, 116 being solid. In another embodiment, multiple hollow arms for further telescoping extension can be employed. Other structural arrangement configured to hold the arms 115, 116 secure in place at the desired extension in play can be employed.

In an embodiment, the hi-hat musical device 100 comprises a hi-hat cabling mechanism 101, including a cable 120. The cabling mechanism 101 is configured such that an upper portion of the cable 120 strings through an opening in the lower arm 106 (e.g., telescoping slider 116), a lower cymbal mount 123, an opening in the lower cymbal 110, a lower cymbal fastener 124, an upper cymbal 111, and an upper cymbal fastener 126, upper cymbal mount 127, and the upper arm 105 (e.g., telescoping slider 115). In an embodiment, a clutch 128 can provide the upper cymbal fastener 125 and upper cymbal mount 127, including a conventional clutch 128 as known in the art. For example, the upper cymbal 111 can be tightened to the cable 120 wherever desired along the cable's 120 length with the clutch setup, just as it is tightened onto the rod of a conventional hi-hat stand with a hi-hat clutch 128. Conventional hi-hat clutches 128 are made of an externally threaded hollow sleeve 126, which can pass through a center upper cymbal 111 hole, where cushioning rings (typically felt) are tightened down on either side of the cymbal by threaded nuts. In embodiments, the sleeve 126 itself is passed through by the hi-hat stand cable 120 it secures to, for example via a wing set screw. In embodiments, the cable 120 of the cabling mechanism 101 can be tightened onto the cymbals 110, 111 in the same manner tightened on a conventional hi-hat stand rod: the upper cymbal 111 can also be fastened to the upper arm 105 with any conventional hi-hat clutch 128 by running the clutch's 128 sleeve 126 down through an opening in the upper arm 105 and the opening in the upper cymbal 111 and tightening the clutch's 128 threaded nuts to hold the upper cymbal 111 to the upper arm 105. The bottom cymbal 111 sits on lower cymbal mount 123 including a hollow sleeve 140, and felt 141, is similarly fixed to the lower arm 106.

The upper cymbal 110 and lower cymbal 111 are positioned horizontally along the cabling mechanism 101. The cymbals 110,111 should meet each other flatly when closed. An upward angle θ in the top arm compensating for the contour of the cymbal, followed by a realigning angle γ down to keep the cymbal-bearing sections of the arms near parallel at the closed position of the cymbals, keep the cymbals from closing one edge before the other. After the upper arm 105 extends past the compression coil 103, the upper arm 105 bends upward at an angle θ for example from about 130 to about 145 degrees then a return inverse angle γ back down, for example 75 to 40 degrees at 1" to 2¼" away from the upward 136 bend, depending on surface angle and maximum height and diameter of cymbals together in closed position. In embodiments, a lesser return angle will help compensate for the differences in cymbal sizes, and allow the cymbals to close neatly, the whole circumference of the edges touching together equally in unison. Other adjustments can be made by ordinarily skilled artisans informed by the teachings of the present specification.

Figure 1F:
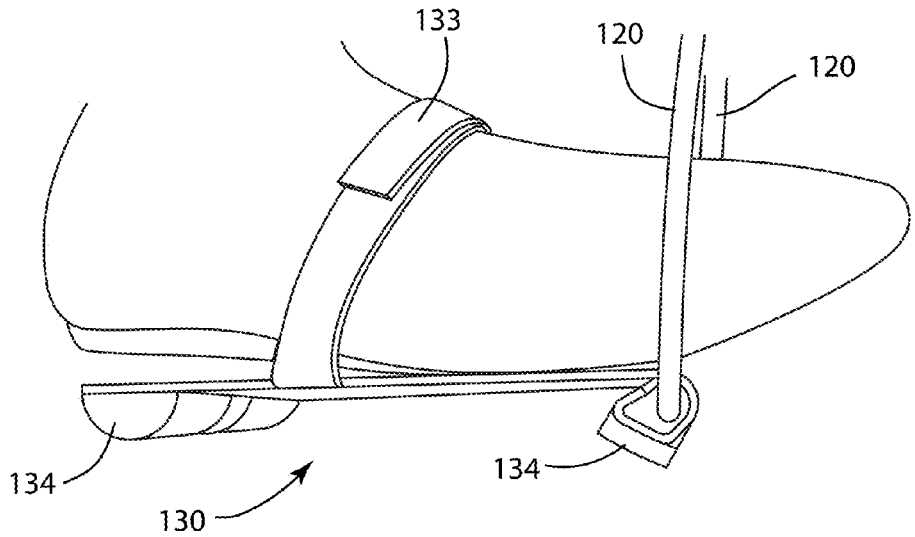
FIG. 1F shows a side view of a foot pedal and cabling mechanism of the hi-hat musical device.

The hi-hat device comprises a foot pedal 130, and the cabling mechanism 101 attaches to upper portion of foot pedal 130. As shown in FIGS. 1A and 1F the cable 120 passes through a cable fastener 135, strings through a channel 139 or groove on the upper portion of the foot pedal 130, and then loops back to the cable fastener 135, which secures the lower portion of the cabling mechanism 101 to the hi-hat device 100. The cable fastener 135 is configured to slide up and down along the looped cable 120 and can be tightened to adjust the length of the cable mechanism 101 between the foot pedal 130 and upper portion of the hi-hat device 100. A foot strap 133 on the foot pedal 130 allows a user to fasten his or her foot to the foot pedal 130. In an embodiment, a pad 134 or other guard can be added to the bottom of the foot pedal 130, for example a foam pad, to protect a floor from scuffing or enhance grip on flooring or both.

The hi-hat device 100 is configured to operably mount and include upper cymbal 110 and a lower cymbal 111. The upper cymbal 110 and lower cymbal 11 each have a convex side 112 and a concave side 113. The concave sides 113 to the upper cymbal 110 and lower cymbal 111 are opposingly disposed opposite each other in an open, non-actuated position 114, also termed the neutral, rest or unbiased position. In operation, when the user's foot is in the down position, pressing a foot pedal 130 to the floor, the hi-hat cymbals are closed together by virtue of the downward force pulling the upper cymbal together with the lower cymbal such that they are in contact with one another in a closed, actuated position. The foot pedal 130 pivots vertically off the floor at the user's heel for full control of the top cymbal's elevation over the bottom cymbal while playing. The user puts the cymbals 110, 111 in the open, rest position by lifting the ball of the foot upward and keeping the heel down, providing substantially the same pedal action as conventional hi-hat cymbals as known in the art. A user can also play the device with a leg up in mid-air as well, such that the user can kick or make any movement to close or open the cymbals, again providing substantially the same pedal action as conventional hi-hat cymbals as known in the art.

Thus a musical user can employ the same musical skills as used on a conventional hi-hat for a standard drum set.

As will be appreciated, the placement of the spring mechanism 102 outside of the cymbals 110, 111 and cabling mechanism 101 allows the hi hat musical device 100 to be operable when resting on a user's leg as, inter alia, no other internal actuation mechanisms are needed between the cymbals 110,111 to operate the device and play the cymbals 110,111 using conventional drumming techniques. Each cymbal 110, 111 secures to the upper arm 105 and lower arm 106, which are connected outside the cymbals at via the spring mechanism 102, where the spring force is applied between the arms to keep the cymbals apart, rather than being exerted from underneath by attaching a spring to a rod within a stand's hollow tube planted on the floor and detached from the user as with a conventional hi-hat.

In an embodiment, the hi-hat device comprises a leg engagement mechanism 117. The leg engagement mechanism can include an upper leg brace 117*a*, such as a support configured to rest on the thigh, attached to the lower arm 106. A pad 118 can be added to the underside of the upper leg brace 117*a* for additional comfort. In embodiment the lower arm 106 is of sufficient length to allow sliders (telescoping sliders) 115, 116 to adjust to fit smaller and larger hi-hat cymbals 110, 111 and in either case rest comfortably on a user's leg and still permit operation. The leg engagement mechanism 117 can also include a leg attachment mechanism 119, for example a strap, belt, or fitted side pads, to secure the hi-hat musical device 100 on the leg. As shown in FIG. 1A, the leg engagement mechanism 117 is attached to the thigh by an adjustable hook-and-loop (i.e.: Velcro™) strap 119 which can be attached left and right sides of the upper leg brace 117*a*, although other conventional attachment mechanisms as known to ordinarily skilled artisans as informed by the teachings of the present specification can be employed. The leg engagement mechanism 117 can also include a lower leg brace 117*b*, which can be attached to can be attached to the arm 106, for example on the telescoping slider 116 as shown in FIGS. 1A-1C. The lower leg brace 117*b* can be configured to be adjustable, for example by being slideably attached to the lower arm 106 or telescoping slider 116. In the embodiment, the leg engagement mechanism 117 thus fastens the lower arm 106 directly to a user's leg, for example the thigh, with the adjustable strap 119, the length of which can be adjusted, for example using cinch rings 137. In embodiments, small solid form-fitting curved wings 138 extending out from both sides of the lower arm 106 can provide side-to-side stability when strapped atop a user's thigh.

Figure 2:
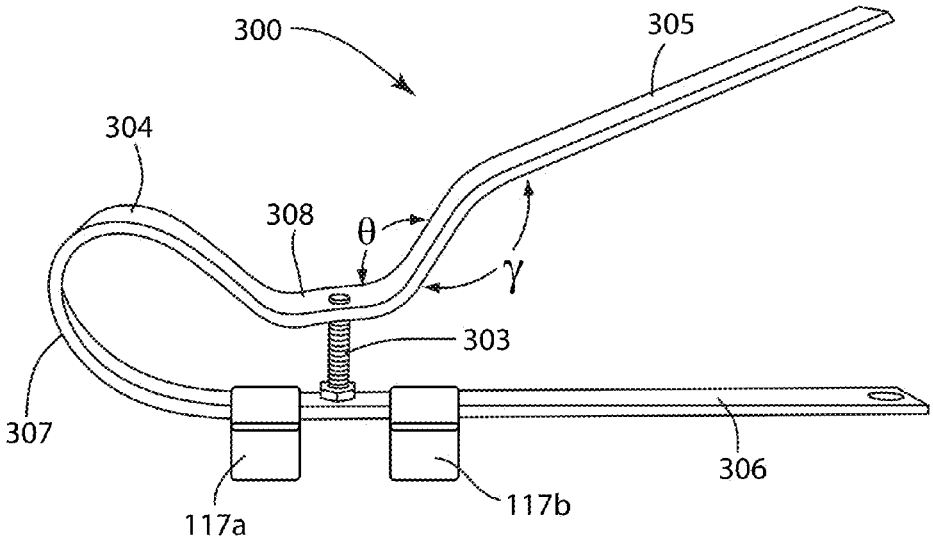
FIG. 2 shows another embodiment of the hi-hat musical device.

FIG. 2 shows an embodiment of the device 300 comprising a streamlined spring mechanism. In the embodiment, the spring mechanism 304 can comprise a C-Spring and having no coil compression spring. The C-Spring can be a modified C-Spring. As shown in FIG. 2, the modified C-Spring includes an upper end 308 that curves upward to form a semi-ellipse such that at the apex 307 of the C-shape the C-spring 304 curves downward and then bends normal to vertical such that the upper end 308 of the flat spring 304 extends horizontally along the hi-hat musical device 100, for example as a cantilever. As shown in the example, the spring mechanism is unitary with the upper arm 305 and lower arm 306. A rigid support 303 between the upper end 308 and lower end 307 of the C-Spring provides a support for the upper arm 305 and lower arm 306, which extend horizontally and act as tension rods. As the upper arm extends horizontally away from a user, the upper arm 308 bends upward at an angle θ, for example from about 130 to about 145 degrees. As the upper arm 308 continues to extend horizontally, the upper arm 308 then bends downward such that the upper arm 308 slopes at an angle to allow an upper hi-hat cymbal and lower hi-hat cymbal to be mounted on the hi-hat musical device, for example a return inverse angle γ back down, for example 75 to 40 degrees at 1" to 2¼" away from the upward bend. In the embodiment the arms 305, 306 are not adjustable, and are configured to fit one size of cymbals, however the device can be configured to include adjustable arms. The lower arm 306 extends horizontally so as to be placed on a user's leg on the thigh, which can be held thereon with a leg engagement mechanism 317. The exemplary leg engagement mechanism shown in FIG. 2 comprises a pair of straps 317*a*, 317*b* on the lower arm 306.

Figure 3A:
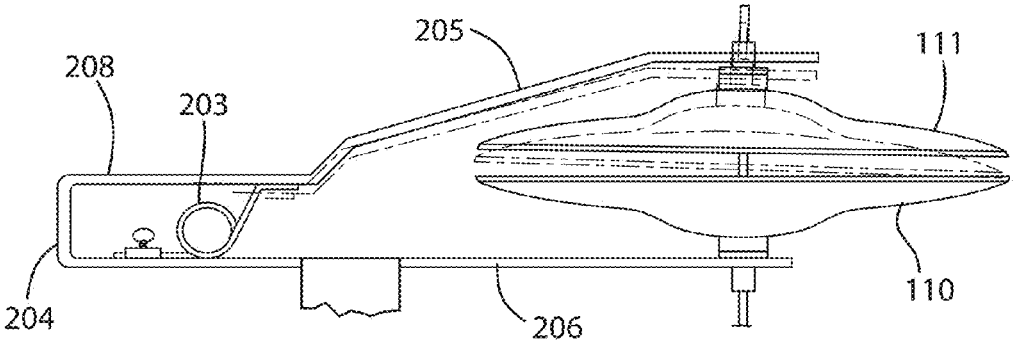
FIGS. 3A-3C show embodiments of the hi-hat musical device including a torsion spring.
Figure 3B:
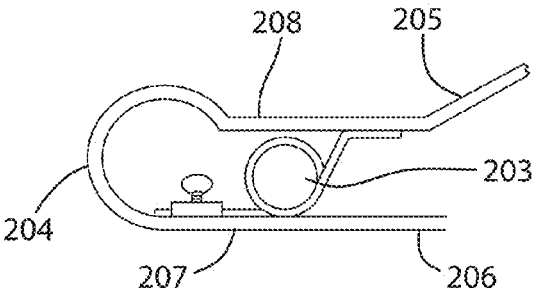
Figure 3C:
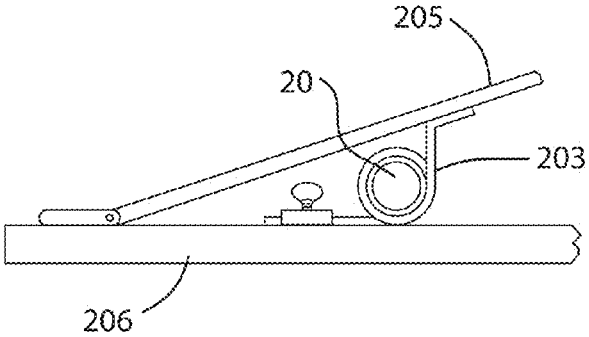

FIGS. 3A-3C shows embodiments of the device 200*a*, 200*b*, 200*c* comprising a spring mechanism 202 including a torsion spring 203. In the embodiment, the spring mechanism 202 can comprise a springs such as a C-Spring as shown in FIG. 3A and FIG. B, or a V-Spring as shown in FIG. 3C, a pair of cantilevered torsion arms 205, 206, as well as other configuration allowing the upper and lower arms to extend along the X axis of the device 100. As shown in FIGS. 3A to 3C, the torsion spring is configured between the upper end 208 and lower end 207 of the flat spring 203 and provides a support for the upper arm 205 and lower arm 206, which extend horizontally along the x-axis of the device 200*a*, 200*b*, 200*c*.

Embodiments of the device 100, 200, 300 can be made from materials that provide sufficient rigidity and resistance to stresses from repeated use. Exemplary materials include aluminum, titanium, plastics and reinforced plastics (e.g. fiber reinforced polymers and laminates), carbon fiber and carbon fiber reinforced materials, and other such materials as known in the art.

While the foregoing written description of the invention enables one of ordinary skill to make and use embodiments thereof, those of ordinary skill will understand and appreciate the existence of variations, combinations, and equivalents of the specific exemplary embodiments and methods described herein. The invention should therefore not be limited by the above described embodiments and methods, but by all embodiments and methods within the scope and spirit of the invention as claimed.

What is claimed is:

1. A hi-hat musical device comprising:

a spring mechanism;

a pair of arms connected to the spring mechanism comprising an upper arm including a mount for an upper cymbal; and a lower arm including a mount for a lower cymbal;

a foot pedal;

a hi-hat cabling mechanism including a cable configured to operatively connect the foot pedal to the hi-hat device, wherein the cable passes through a channel formed through the lower arm, a pair of hi-hat cymbals when mounted and fastened, and the upper arm; and a leg engagement mechanism for mounting the hi-hat musical device on a user's leg.

2. The hi-hat musical device of claim 1 wherein the spring mechanism comprises a coil compression spring.

3. The hi-hat musical device of claim 1 wherein the hi hat musical device comprises a cymbal adjustment mechanism for adjusting and setting the open distance between an upper hi-hat cymbal and a lower hi-hat cymbal mounted on the hi-hat musical device.

4. The hi-hat musical device of claim 3 wherein the cymbal adjustment mechanism comprises a tension adjustment mechanism configured to adjust the tension of the spring mechanism.

5. The hi-hat musical device of claim 4 wherein the spring mechanism comprises a coil compression mechanism and the tension adjustment mechanism is positioned to adjust the tension of the coil compression mechanism.

6. The hi-hat musical device of claim 1 wherein the spring mechanism comprises a flat spring.

7. The hi-hat musical device of claim 6 wherein flat spring comprises a C-Spring.

8. The hi-hat musical device of claim 7 wherein a lower end. of the C-Spring is positioned on and fastened to the lower arm, curves upward to form a semi-ellipse such that at an apex of a C-shape the C-spring curves under and then bends normal to vertical such that the upper end of the flat spring extends horizontally along the hi-hat musical device.

9. The hi-hat musical device of claim 7 wherein the C-Spring comprises a monotonic spiral.

10. The hi-hat musical device of claim 9 wherein the monotonic spiral comprises a ϕ curve or Fibonacci spiral.

11. The hi-hat musical device of claim 6, wherein a coil compression spring is positioned vertically between a lower end and an upper end of the flat spring.

12. The hi-hat musical device of claim 7, wherein an upper end of the C-spring is attached to a lower surface of the upper arm, and a lower end of the C-spring is attached to a top surface of the lower arm.

13. The hi-hat musical device of claim 1 wherein the spring mechanism comprises a torsion spring.

14. The hi-hat musical device of claim 1 wherein the pair of arms are adjustable to accommodate different sized hi-hat cymbals.

15. The hi-hat musical device of claim 14 wherein the pair of arms each include a telescoping portion adjustably fastened to each arm.

16. The hi-hat musical device of claim 15 wherein the leg engagement mechanism in comprises a lower leg engagement mechanism attached to the telescoping portion.

17. The hi-hat musical device of claim 1 further comprising: an upper cymbal and a lower cymbal positioned horizontally along the cabling mechanism.

18. The hi-hat musical device of claim 1 wherein the cabling mechanism operably attaches to the foot pedal to the hi-hat device.

19. The hi-hat musical device of claim 1 wherein a clutch attaches an upper portion of the cabling mechanism to the upper arm of the hi-hat device.

20. The hi-hat musical device of claim 1 wherein the leg engagement mechanism comprises an upper leg brace configured to rest on a user's thigh attached to an upper portion of the lower arm and a lower leg brace which can be attached to a lower portion of the lower arm.

* * * * *